US008225702B2

(12) United States Patent
Weigelt

(10) Patent No.: US 8,225,702 B2
(45) Date of Patent: Jul. 24, 2012

(54) STRIPPING DEVICE

(76) Inventor: Harald Weigelt, Kürten (DE)

( * ) Notice: Subject to any disclaimer, the term of this patent is extended or adjusted under 35 U.S.C. 154(b) by 873 days.

(21) Appl. No.: 10/522,078

(22) PCT Filed: Jul. 25, 2003

(86) PCT No.: PCT/EP03/08239
§ 371 (c)(1),
(2), (4) Date: Jul. 5, 2005

(87) PCT Pub. No.: WO2004/011172
PCT Pub. Date: Feb. 5, 2004

(65) Prior Publication Data

US 2006/0071062 A1 Apr. 6, 2006

(30) Foreign Application Priority Data

Jul. 25, 2002 (EP) ..... 02016591

(51) Int. Cl.
*B21D 45/06* (2006.01)
*B21D 45/00* (2006.01)

(52) U.S. Cl. ..... 83/139; 83/140; 83/689.91

(58) Field of Classification Search ..... 83/125–145, 83/698.91
See application file for complete search history.

(56) References Cited

U.S. PATENT DOCUMENTS

| | | | | |
|---|---|---|---|---|
| 1,723,935 | A | 8/1929 | Henricson | |
| 2,168,377 | A | 8/1939 | Wales | |
| 2,319,568 | A * | 5/1943 | Wales | 83/50 |
| 2,371,565 | A * | 3/1945 | Whistler et al. | 83/123 |
| 2,760,574 | A * | 8/1956 | Taylor | 83/140 |
| 3,465,634 | A * | 9/1969 | Blais | 83/695 |
| 3,871,254 | A | 3/1975 | Whistler et al. | |
| 3,971,276 | A * | 7/1976 | Billows | 83/164 |
| 4,246,815 | A * | 1/1981 | Hugo | 83/139 |
| 4,428,262 | A * | 1/1984 | Vlahek | 83/139 |
| 4,862,782 | A | 9/1989 | Ernst et al. | |
| 4,993,295 | A | 2/1991 | Dacey, Jr. | |
| 5,056,392 | A * | 10/1991 | Johnson et al. | 83/140 |
| 7,707,919 | B1 * | 5/2010 | Moellering | 83/111 |

FOREIGN PATENT DOCUMENTS

| | | |
|---|---|---|
| DE | 812 498 C | 8/1951 |
| DE | 2345513 | 10/1974 |
| DE | 29804632 | 7/1998 |
| FR | 1 456 310 A | 1/1967 |
| GB | 789408 | 1/1958 |

* cited by examiner

*Primary Examiner* — Laura M. Lee
(74) *Attorney, Agent, or Firm* — Knobbe Martens Olson & Bear LLP

(57) ABSTRACT

In the case of a stripping device (3) for use with a cutting tool (1) with a cutting element, in particular a punch (2), for machining a workpiece, in particular a curved metal sheet (6), at least one fastening piece (4, 28, 40) for fastening it to the cutting tool, a spring-elastic element (21) arranged outside the workpiece contact region, a stripping element (15, 34) which comes into contact with the workpiece and surrounds the cutting element (2), and at least one guide element (11, 26, 33) guiding the stripping element (15, 34) being provided, a device for securing against rotation is provided to essentially prevent the stripping element (15) from rotating.

25 Claims, 4 Drawing Sheets

STRIPPING DEVICE

BACKGROUND

1. Field

The invention relates to a stripping device for use with a cutting tool with a cutting element, in particular a punch, for machining a workpiece, in particular a curved metal sheet, at least one fastening element for fastening it to the cutting tool, a spring-elastic element arranged outside the workpiece contact region, a stripping element which comes into contact with the workpiece and surrounds the cutting element, and at least one guide element guiding the stripping element being provided.

2. Description of the Related Art

Stripping devices are known in conjunction with various types of cutting tools (DE 196 05 113 A1, DE 40 35 938 A1, DE 42 35 972 A1 and WO 99/67038 A1). A stripping device of this type is required for enabling, in particular in the case of punches or other cutting elements, the machined workpiece, in particular metal sheet, to be stripped off from the cutting element, in particular punch. During the cutting process, in particular punching process, a front surface of the stripper is placed against the surface of the workpiece, deflects inward somewhat during the penetration of the workpiece by the punch and, when the cutting tool is pulled back out of the workpiece, springs out again, thus ensuring that the, for example, punch will be pulled out of the workpiece.

Various models of strippers are available commercially. Most of them have a fastening plate by means of which they can be fastened to the cutting tool, in particular a punch fastening plate. The stripper body is composed, for example, as a rubber spring of a hard plastic, the front surface of which is formed in accordance with the contour of the workpiece. The shaping can be undertaken here by trimming. The rubber spring surrounds the punch on all sides. In most cases, the shape of the front surface of the stripper is not symmetrical, since the workpiece to be machined generally has an irregular shaping.

U.S. Pat. No. 2,168,377 discloses a stripping device for use with a punch for machining a flat, planar metal sheet, in which an outer element is fastened to a specially configured retaining plate of a cutting tool via screws and bolts. The outer element is provided on its inside with a longitudinal opening into which a stripping element, and in it the punch, are fitted. A spring-elastic element in the form of a helical spring is fitted between the stripping element, the outer element and the punch. The stripping element has an essentially straight section and a protruding section, which can be supported on a projection within the longitudinal opening of the outer element or is secured thereon in order not to be pushed inadvertently out of the element.

U.S. Pat. No. 1,723,935 discloses a similar construction of a stripping device as the above publication. In the same manner as said publication, U.S. Pat. No. 1,723,935 also uses a helical spring which is arranged within an outer guide sleeve between punch, stripping element and a special fastening device for fastening it to the cutting tool. The outer guide sleeve is screwed onto a fastening piece which is fastened to a further fastening piece which is connected via a flange to the cutting tool via a screw connection.

U.S. Pat. No. 4,993,295 discloses a stripping device for use with a punch for machining a planar metal sheet, in which, as in U.S. Pat. No. 1,723,935, guide surfaces between an outer guide sleeve and a stripping element are relatively short, which means that, in the event of higher loads, the stripping element may tilt within the guide sleeve. As spring-elastic element, various disk springs are provided which are layered on one another within the guide sleeve in such a manner that the curved surfaces in each case are directed toward one another. A punch is arranged within the spring-elastic element.

The stripper also has the task of keeping the workpiece in the desired shape during the machining process. This is particularly important if punchings are to be undertaken in the region of metal-sheet edges, since deformations may easily occur there because of the punching process. However, the stripper is not intended to automatically deform the workpiece, but merely to keep the latter in the desired, premanufactured shape. If a rubber spring stripper which completely surrounds a punch and has an irregular front shaping facing the metal sheet is provided, this proves problematic if the stripper, after a number of punching processes, rotates around the punch. The shaping of the surface of the stripper then does not correspond to the shaping of the surface of the metal sheet which is to be punched, for which reason problems of quality and complaints may occur in this case.

For this purpose, DE 812 498 discloses a stripping device for a punch with a helical spring which is arranged between a stripper plate and a punch head. The helical spring surrounds the region of the punch. Three strips are provided which are fastened between the punch head and stripper plate and maintain a distance between these two elements. The fastening takes place via screws and elongated holes, so that the distance between stripper plate and punch head can be adjusted. By contrast, a rotation of the stripper plate is scarcely possible because of the strips.

FR 1 456 310 discloses a stripping device which, in one embodiment, comprises a helical spring and, in another, comprises an elastic element which is fitted between two fixed plates. In the case of the second embodiment, a screw bolt is arranged between the two fixed plates, in a similar manner as provided by the strips in DE 812 498 for stably connecting the two plates. The screw bolt can also prevent the plates from rotating in relation to each other.

However, these publications do not disclose any possibility of allowing matching to the particular shaping of deformed metal sheets. In all of the publications only straight metal sheets are ever punched. However, it is required in particular in the automobile industry to provide stripping devices which match the particular shapings of deformed metal sheets or can be matched to them without any problem, essentially do not leave any traces on the punched metal sheets and have a long service life, i.e. of such stable design that they withstand a large number of strokes, in particular more than one million strokes without any maintenance. In addition, the stripping device is to be designed in such a manner that a simple and rapid changing and interchanging of stripping devices can be undertaken. This is not possible with the devices of the prior art that are fastened to the cutting tool in a complicated manner.

In order to prevent rotation, Dayton Progress GmbH has also disclosed a spring-mounted steel stripper. A means of securing against rotation for the punch is formed by the punch being constricted in cross section in a subregion and being flattened in rectangular form. A section of the stripper, which section is fastened to the steel stripper by means of screws, engages in this region.

This solution proves to be disadvantageous because of its susceptibility to failure due to limited stability in the region of the small fastening screws and risk of fracture of the constricted punch. Since the individual parts of a stripper have to be matched precisely to one another and a complicated mounting is frequently required, in the case of alternatives manufactured manually average prices of 1800 euros per piece arise. In contrast to this, the pure rubber strippers, as described further above, cost approx. 100 euros per piece. However, these have the disadvantage, in addition to the disadvantages already mentioned above, that, when a metal sheet is punched from the inside, only small piece numbers for use with only certain shapes are possible. The steel stripper also has the disadvantage that the screws retaining the engaging section on the steel stripper are very small and frequently do not permanently withstand the forces which occur, particularly since said screws are loaded transversely. The durability of a rubber stripper, as described above, is approx. 80 000 strokes, meaning that correct stripping is no longer ensured or possible and the manufacturing reliability is therefore impaired.

SUMMARY

The present invention is therefore based on the object of providing an improved stripping device which is stable and in which, in particular, a securing against rotation within the range of a hundredth of a millimeter is possible and unilateral shearing forces can be eliminated. In addition, high numbers of strokes of, in particular, more than one million strokes are to be possible in particular for use in the automobile industry, i.e. the durability and stability are to be improved in comparison to the stripping devices of the prior art. In addition, the stripping device is to be comparatively cost-effective and as compact as possible.

This object is achieved by a stripping device with a device for securing against rotation being provided to essentially prevent the stripping element from rotating.

A stripping device for use with a cutting tool with a cutting element, in particular a punch, is thus provided, in which a long-term durability of the spring-elastic element is made possible, since the latter does not come into contact with the workpiece. In addition, it is preferably loaded centrically and in a manner free from torque, as a result of which a nonuniform wear or loading is likewise prevented. A durability of the spring-elastic element of more than one million strokes is thus possible. Owing to the use of a number (visible at a glance) of individual parts which, plugged together, produce the stripping device, the latter is more robust than the stripping devices of the prior art. The use of a guide element, preferably of guide sleeves or guide bushings, advantageously also enables a reproducible movement of the stripping device in relation to the cutting tool or the cutting element, in particular a punch. In addition, guidance by means of columns is no longer necessary, as is required in numerous strippers of the prior art, in order to enable it to be attached fixedly in the cutting tool. Such columns are intended, in particular, to intercept transverse forces which may occur during the cutting process and may rotate or displace the stripper. In addition, a more cost-effective solution is provided than, for example, in the case of the usual, manually constructed steel strippers of the prior art. This is made possible, in particular, by the fact that the manufacturing outlay is very much smaller than in these products.

The arrangement of the spring-elastic element outside the workpiece contact region affords various advantages. By this means, the spring-elastic element is no longer constantly in contact with oils and greases which gradually corrode and destroy it. In addition, by means of the contact of the workpiece with the stripping element instead of the spring-elastic element, an essentially inflexible contact surface is provided which enables the workpiece to be kept in shape and, conversely, is not deformed by the workpiece. The stripping element therefore particularly preferably consists of bronze or of another material which can be matched to the shape of the workpiece surface and is firm enough not to be able to be deformed by the workpiece during the machining process. A material is preferably selected which makes it possible to configure the stripping element individually in respect of its front surface shape in order to match the latter to the workpiece to be cut. The spring-elastic element is preferably a rubber spring or preferably consists of another spring-elastic, restoring and/or flexible material. Particularly when a rubber spring is used, a fatigue fracture, for example of a helical spring, can be avoided.

The device for securing against rotation preferably comprises a stripping element with an irregular cross-sectional shape and/or an elongated hole or polygonal hole in the guide element. It has proven particularly advantageous if the device for securing against rotation has a pairing, formed asymmetrically at least in one orientation, of stripping element and hole or opening in the guide element so as to ensure that the stripping element will be installed with a unique orientation, in particular an elongated hole with three straight sides and one curved side and a correspondingly designed stripping element. The provision of a stripping element with a nonuniform cross section or asymmetrical shape at least in part and, in particular, of a cross section, matched thereto, of the opening in the guide element in which the stripping element is guided, a rotation and a wrongly oriented installation of the stripping element in the guide element can be essentially avoided. By virtue of the provision of an elongated hole or polygonal hole and/or of a stripping element with an irregular cross-sectional shape, an unambiguous position is specified for the installation, so that the stripping element, which is shaped on its front surface in accordance with the contour of the workpiece, cannot inadvertently be installed rotated in its position even when changed rapidly. In addition, a more rapid installation is possible, since the precise position of the stripping element does not first have to be determined, but rather is predetermined by the shaping of the stripping element and of the opening in the guide element, preferably of the guide sleeve or guide bushing, and by the preferred provision of inner and outer guide surfaces on the stripping element. A more rapid, easier and more precise installation of the stripping device on the cutting tool is therefore possible than is possible in the case of the stripping devices of the prior art. In addition to the rapid and easy installation and changing of a stripping element and the correct orientation, this also enables damage of the workpiece which is to be punched to be avoided. Even metal sheets of complex shape can therefore be machined essentially without damage, in particular likewise because of the advantageous possibility of matching the front surface of the stripping element to the shape of the workpiece, in particular metal sheet, as a result of which markings of the workpiece around the punched hole can be avoided. In the case of the stripping devices of the prior art, such markings regularly cannot be avoided, since the front surface shape of the stripping element is not matched to the shaping of the workpiece (shaped metal sheet) which is to be machined (punched). For example, in the case of vehicle doors, after the three-dimensional shaping thereof, holes have to be provided in the lower region, the punching of which holes using the above-described devices of the prior art is not possible without damaging the door profile, since in this case neither a securing against rotation nor a matching of the shaping of the front surface region of the stripping element to that of the door profile are provided.

The spring-elastic element is preferably arranged between stripping element or guide element and cutting tool and/or within the guide element. This avoids contact of the spring-elastic element with the workpiece. In addition, the spring-elastic element is held fixedly in the stripping device. By this means, a uniform loading is possible which keeps the wear of the spring-elastic element as small as possible. In addition, a defined position of the spring-elastic element is established, an interchanging of said element in the case of wear also easily being possible at any time.

The stripping element and the spring-elastic element are preferably oriented, surrounding the cutting element, in such a manner that they can be loaded in a manner essentially free from torque and, in particular, centrically. This advantageously avoids a nonuniform wear and a tilting of the spring-elastic element and of the stripping element. In addition, a reproducible position of the spring-elastic element is predetermined, in particular for the interchanging situation, which means that an interchanging can be carried out rapidly and without any problem.

At least one guide sleeve is preferably arranged as a guide element outside the stripping element, at least partially surrounding the latter in a guiding manner, and/or at least one guide bushing is arranged as a guide element within the stripping element, guiding the latter. The provision of a guide element enables the stripping element to be guided, which permits a defined movement of the stripping element along the cutting element, in particular punch. In addition, the stripping element preferably has at least one guide surface on its inside facing a fitted cutting element, in particular the stem thereof. This permits the stripping element to also be guided along the cutting element, in particular the stem thereof. An inner and outer guidance of the stripping element is therefore possible. A tilting as occurs in particular in the case of rubber springs of the prior art no longer has to be of concern. On the contrary, the exact movement is still maintained even after more than 1 000 000 strokes.

The stripping element preferably has an essentially straight section and a protruding section, guide surfaces being provided on the straight and the protruding sections of the stripping element. At least one guide surface is preferably provided between stripping element and guide element, the length of which surface can be selected as a function of the forces acting on the stripping device, in particular shearing and lateral forces, in order to ensure tilt-free guidance. The provision of a straight and of a protruding section of the stripping element provides an even better means of securing against tilting in relation to the cutting element and the guide element, since two guide surfaces are provided which are arranged, in particular, at a distance from each other. The particular length of the guide surface or guide surfaces can be selected as a function of the forces acting on the stripping device. In this case, a longer guide surface is preferably selected if the forces which occur are higher.

In order to improve the sliding of the stripping element within the guide element, a lubricant, in particular a lubricant suitable for maintenance-free lubrication, in particular a solid lubricant, is preferably provided at least in a subregion of the straight section. The use of a solid lubricant proves advantageous particularly in the material pairing of bronze and hardened steel for the individual elements sliding on one another. In particular, a combination of oil and graphite is suitable as the solid lubricant. The provision in particular of maintenance-free lubrication is not provided in the prior art, for example U.S. Pat. No. 2,168,377, U.S. Pat. No. 1,723,935 and U.S. Pat. No. 4,993,295. In these cases, a lubrication of the surfaces sliding one inside another can be brought about only by disassembling the entire device. However, maintenance-free lubrication proves advantageous on account of the poor accessibility of the lubricating points and the otherwise long service life of the stripping device.

The guide element is preferably formed integrally with the fastening piece or guide element and fastening piece are formed as elements which can be joined together. An integral formation is suitable in particular in the case of higher forces, since, in this case, an inadvertent tilting of guide element and fastening piece one inside the other does not have to be of concern. The stability and compactness of the stripping device are therefore increased. By contrast, the formation of guide element and fastening piece as elements which can be joined together is suitable, in particular in the case of lower forces. This advantageously, in particular, also enables just one fastening with just one fastening means, in particular a screw, to be selected. As a result, the fastening piece can be designed such that it is smaller and thus more space-saving.

At least one protruding region and/or protruding section, in particular a claw- or clamp-shaped section, is or are particularly preferably provided on the circumference or edge of the fastening piece for engaging around a fastening device of the cutting tool. This enables the fastening piece to be centered on the fastening device, in particular a fastening plate. A secure and centered fastening or locking of the stripping device to the cutting tool or the fastening device thereof is, as a result, also possible by means of just one single fastening means, in particular a screw. A compatibility of the fastening piece with a standardized fastening plate of a cutting tool proves very advantageous, since, as a result, a manufacturing of individual parts, as in the case of the stripping devices of the above-described prior art, does not need to take place and an accuracy in terms of location is provided on each existing fastening plate. A rapid and easy interchanging of a stripping device is therefore possible even for unskilled operating personnel.

The stripping device is particularly preferably used together with a V-belt drive, since, with a drive of this type, not only can particularly high forces be transmitted, but this also has to take place particularly accurately. In this case, the means of securing against rotation lies within the range of a hundredth of a millimeter, which cannot be obtained with the stripping devices of the prior art.

BRIEF DESCRIPTION OF THE DRAWINGS

To further explain the invention, a number of exemplary embodiments are described in more detail below with reference to the drawings, in which.

DETAILED DESCRIPTION

Figure 1:
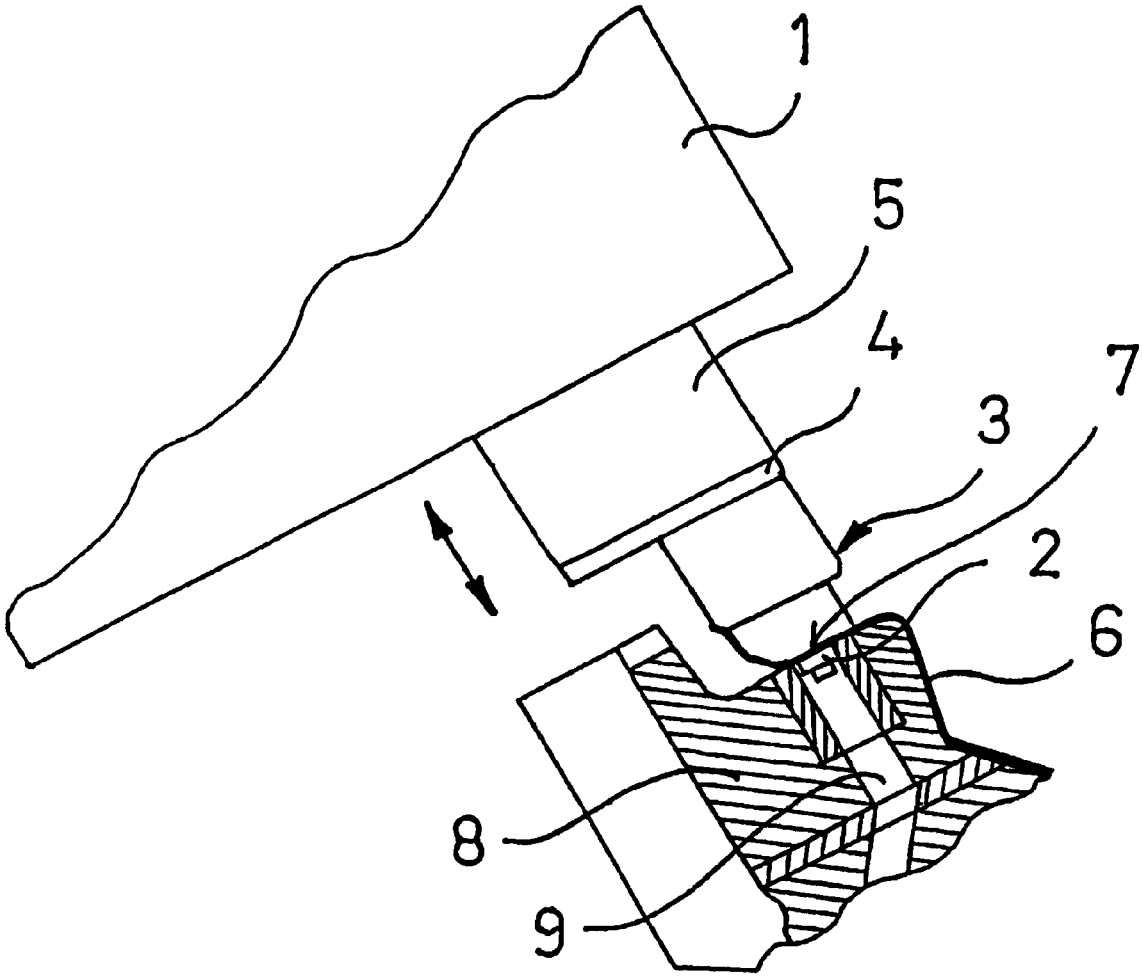
FIG. 1 shows a schematic diagram of a punch installed in a cutting tool together with a stripping device according to the invention during the process of punching a metal sheet.

FIG. 1 shows a schematic diagram of a cutting tool 1 in the region of the detail of a punch 2 with a surrounding stripping device 3. The stripping device 3 is fastened to a fastening plate 5 of the punch via a fastening plate 4. The fastening plate 5 for its part is mounted on the cutting tool 1. The fastening plate 5 has a standardized shape. FIG. 1 illustrates the situation in which the punch penetrates a metal sheet 6, as workpiece to be machined, in a punching manner. During the punching process, the metal sheet bears against a front surface 7 of the stripping device 3. After penetrating the metal sheet, the punch dips into a mating punch 8. The section punched out of the metal sheet falls through a passage opening 9 provided in the mating punch into a collecting container (not illustrated).

Figure 2:
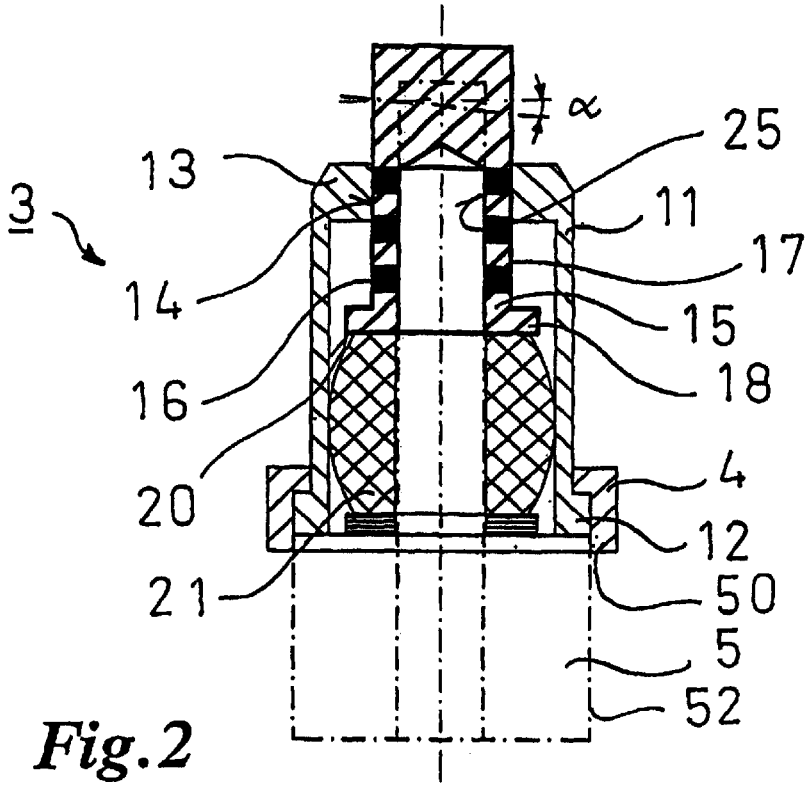
FIG. 2 shows a sectional view of a first embodiment of a stripping device according to the invention.
Figure 3:
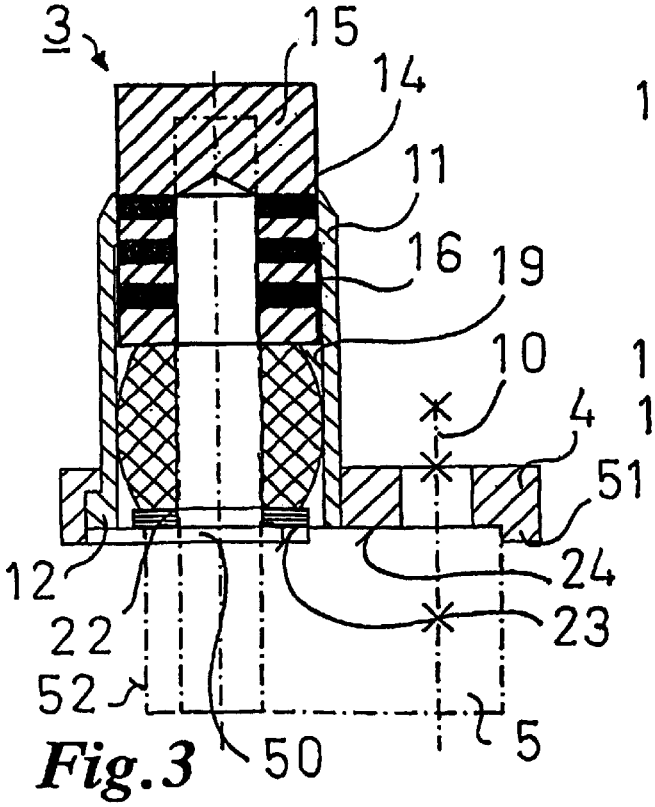
FIG. 3 shows a sectional view, rotated through 90°, through the stripping device according to FIG. 2.
Figure 4:
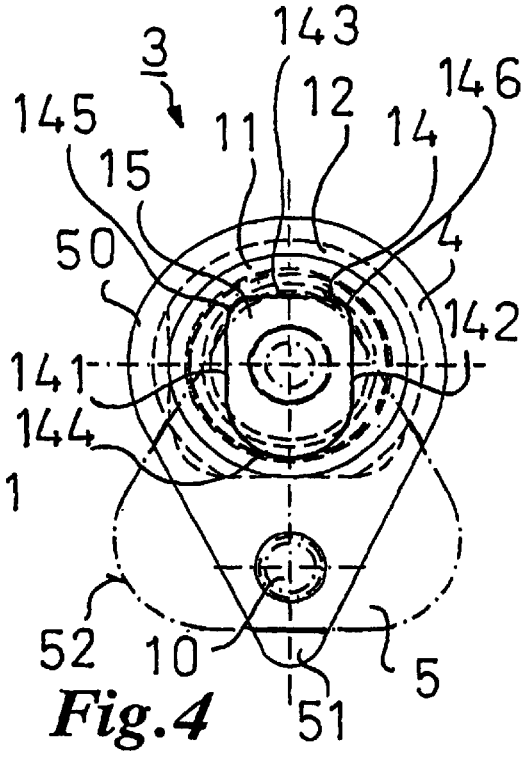
FIG. 4 shows a plan view of the stripping device according to FIG. 2.
Figure 5:
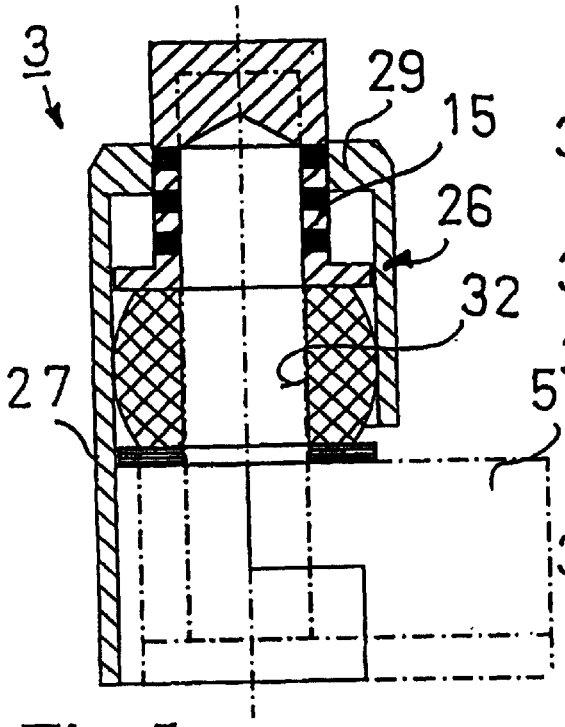
FIG. 5 shows a longitudinal sectional view of a second embodiment of a stripping device according to the invention for use in the case of average forces which occur.
Figure 6:
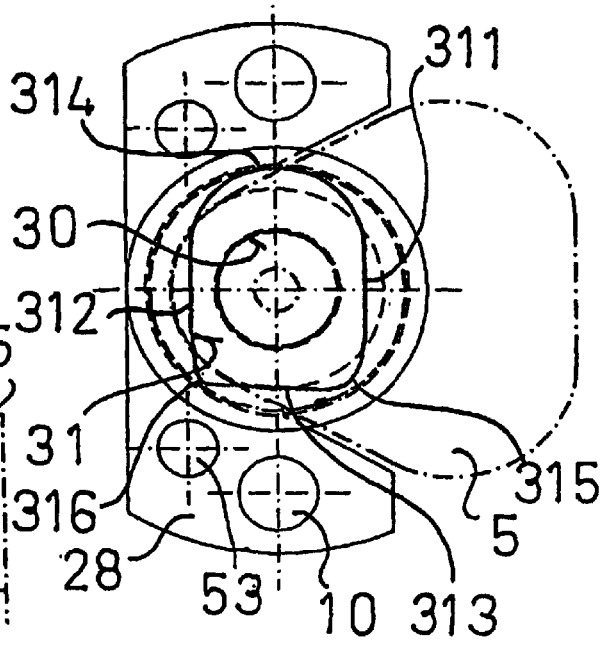
FIG. 6 shows a plan view of the embodiment according to FIG. 5.
Figure 7:
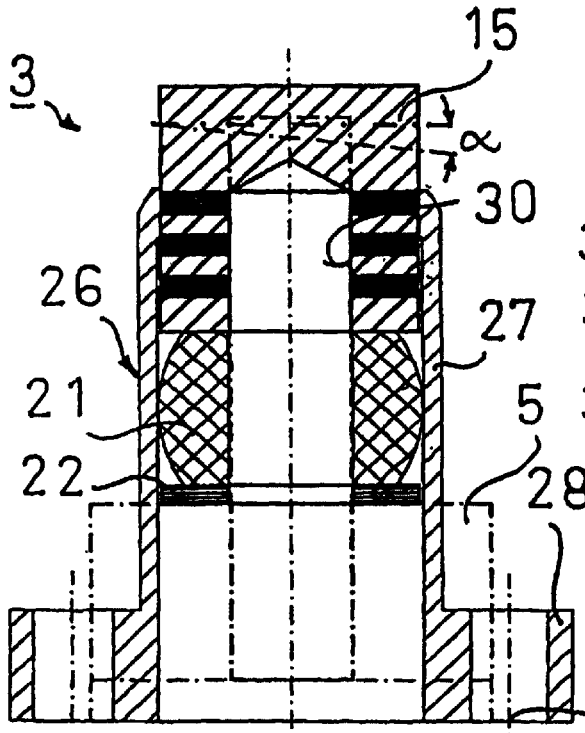
FIG. 7 shows a longitudinal sectional view, rotated through 90°, of the stripping device according to FIG. 5.
Figure 8:
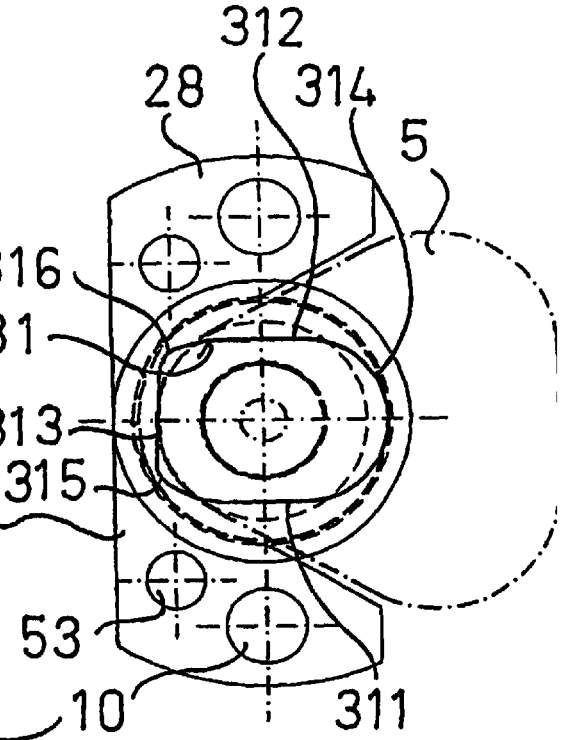
FIG. 8 shows a plan view of a further embodiment of a stripping device according to the invention with a stripping element which is rotated through 90° with respect to the embodiment in FIG. 6.

As can be clearly gathered from FIG. 1, the stripping device has a front surface shape corresponding to the shape of the metal sheet. As a result, the metal sheet is supported during the punching process and at the same time is not deformed. The shaping of the front surface of the stripping device can be undertaken on-site at the particular user. As a function of the forces which occur, the stripping device may be designed differently in each case, as illustrated in detail in the following figures. FIGS. 2 to 4 indicate an embodiment which is suitable more for smaller forces, FIGS. 5 to 8 an embodiment which is suitable for greater forces, and the embodiment according to FIGS. 9 to 11 a variant which is suitable for high forces. The front surfaces of the stripping devices can be formed such that they differ correspondingly.

FIG. 2 illustrates a longitudinal sectional view of a first embodiment of the stripping device 3. The stripping device 3 is fastened to the fastening plate 5 of the cutting tool via the fastening plate 4, as can be gathered better in particular from FIG. 3. In this embodiment, this is undertaken merely by an indicated screw 10, which can be seen better in FIG. 4. The fastening plate 4 fastens a guide sleeve 11 of the stripping device. As can be gathered from FIGS. 2 and 3, the fastening plate 4 protrudes inward in its upper region and, in the process, engages over a downwardly protruding section 12 of the guide sleeve fitted into the fastening plate. As can be gathered in particular from FIG. 4, the protruding section 12 is provided only along a subregion of the circumference of the guide sleeve. This suffices in order to firmly hold the guide sleeve and to secure it against tilting. In the region in which the screw 10 is plugged through the fastening plate, the guide sleeve is formed without a protruding section, in the same manner as in the region offset 90° with respect thereto, which can be seen on the left in FIG. 4. This enables the guide sleeve to be offset by 90° within the fastening plate. An elongated hole 14 which is provided in an upper end plate 13 of the guide sleeve and which may alternatively be a polygonal hole can likewise be offset as a result by 90°, which proves advantageous in certain applications, since fewer different stripping devices have to be provided as a result.

The guide sleeve 11 is essentially cylindrical and is provided in its upper region with the end plate 13, which runs essentially at right angles to the circumferential surface of the guide sleeve and has elongated hole 14. A stripping element 15 is arranged within the guide sleeve and the elongated hole. The stripping element 15 is guided within the guide sleeve and is slidable. This is made possible by provision of a lubricant 16, in particular a solid lubricant. The stripping element has a straight section 17 and a protruding section 18. The lubricant 16 is provided in the region of the straight section 17. The protruding section 18 protrudes essentially as far as the inner surface 19 of the guide sleeve and is guided on this guide surface in a sliding manner. As can be gathered in particular from FIG. 3, the protruding section 18 is not provided over the entire circumference of the stripping element 15, but merely along the longitudinal sides. The straight section therefore has a different wall thickness, as can be gathered from FIGS. 2 and 3.

The elongated hole and the stripping element have an irregular cross section. This is distinguished by three straight sides 141, 142, 143 and one curved side 144. Corner transitions 145, 146, which are in each case provided with radii, are formed between the two long straight sides 141, 142 and short straight side 143. Owing to this irregular and at least partially asymmetrical configuration of the cross sections, when the stripping element is installed, the correct orientation thereof can be ensured, with rapid and easy installation. In addition, straight, comparatively large surfaces on the stripping element are advantageously provided for absorbing forces when a means of securing against rotation is produced.

In order to provide damping and a restoring mechanism, a spring-elastic element 21, for example in the form of a rubber spring, is provided bearing against the protruding section 18, on the lower side 20 thereof. Said element, in the same manner as the stripping element 15, surrounds the punch. However, in contrast to the stripping element, said element is arranged around the punch concentrically with essentially the same wall thickness. A retaining disk 22, the outer surface 23 of which is essentially aligned with the outer surface 24 of the fastening plate 4, is arranged on the other side of the spring-elastic element. This produces a defined mating surface for supporting the spring-elastic element.

On the fastening plate 4, a region 50 protruding at the edge over the actual outer surface 24 and a further section 51 protruding in a claw- or clamp-shaped manner are provided. This can best be seen in FIG. 4. The protruding region 50 and the protruding section 51 engage around the outer edge 52 of the fastening plate 5 of the cutting tool. As a result, a centering of the fastening plate 4 and therefore of the entire stripping device 3 and a secure locking to the fastening plate 5 of the cutting tool by means of just one screw 10 are possible.

In the region of the elongated hole 14 in the end plate 13, the stripping element 15 is guided from the outside and, along its passage opening 25, is guided from the inside on the punch which is to be plugged here through said opening. For this purpose, the fit on the punch is preferably designed as a snug fit.

The front surface of the stripping element 15 is beveled or shaped in accordance with the shape of the workpiece. The passage opening 25, which is already provided in the stripping element and is intended for passing the punch through, is also completely driven through the stripping element, as is already indicated by the broken lines in FIGS. 2 and 3. In this embodiment, a bevel angle $\alpha$ of up to 5° is preferably selected. For larger bevel angles, one of the embodiments according to FIGS. 5 to 8 is preferably selected. In these, the bevel angle $\alpha$ is preferably up to 10°. The further shaping of the front surface of the stripping element 15 is preferably matched to the shaping of the workpiece to be machined, in particular metal sheet of complex shape. It is also possible, by means of this matching, to avoid inadvertent markings caused by the stripping element on the surface of the punched workpiece. Such markings, in particular circular markings, regularly occur in the case of the devices of the prior art and lead to a reduced quality of the punched workpieces or to wastage.

In contrast to the embodiment according to FIGS. 2 to 4, in the embodiments according to FIGS. 5 to 8 the fastening plate is formed integrally with the guide sleeve. In addition, this guide sleeve 26 is designed such that it is longer in the region of its straight section 27 than the guide sleeve 11 according to FIGS. 2 and 3. The fastening plate part 28 of the guide sleeve 26 has a greater material thickness than the fastening plate 4 according to FIGS. 2 and 3. In addition, as can be gathered from FIGS. 6 and 8, two fastening screws 10 and two fixing pins 53 can be provided in it to fasten it to the cutting tool or to the fastening plate of the punch. The thicker fastening plate part results in greater stability, as a result of which the larger lateral and shearing forces can be compensated for.

In contrast to the embodiments according to FIGS. 2 to 4, the guide sleeve is designed to be of such a length that it can be attached directly on the cutting tool and, in the process, at the same time covers the fastening plate 5 of the punch having, in particular, a standardized shaping. This can be gathered in particular from FIGS. 5 and 7. The covering is merely on one side, as can be gathered from FIG. 5, in a manner similar to in the above region 50 according to FIGS. 2 to 4, for which reason the circumference of the guide sleeve is not of uniform length. In the region of the fastening plate of the punch, the guide sleeve is designed such that it is shorter in order to end above said plate.

The difference of the embodiments according to FIGS. 5 to 7 and 8 resides in the fact that, although in both cases an elongated hole or polygonal hole is provided, this is arranged offset by 90°. This possibility has already been discussed with reference to FIGS. 2 to 4. The rotation of stripping element or guide sleeve through 90° is clear from FIGS. 6 and 8. The remaining design of the stripping element and of the guide sleeve and of the spring-elastic element and of the retaining disk is essentially identical in both embodiments. In all of the embodiments illustrated, after installation and fastening inadvertent rotation is no longer possible, since the provision of the elongated hole 31 with three straight sides 311, 312, 313 and one curved side 314 and with corner transitions 315, 316, which are provided with radii or of a different hole shaped as desired and the corresponding design of the stripping element result in the provision of a means of securing against rotation which lies in the range of a hundredth of a millimeter. The stripping element preferably consists of high-quality bronze. The guide sleeve preferably consists of steel. On account of this pairing of material, a particularly high-quality guidance of the stripping element in the steel body of the guide sleeve can be produced, with it being possible to provide long-term durability or service life of the stripping element. This amounts to approximately five to ten times the stripping devices known hitherto. The only wearing part is the spring-elastic element. However, this withstands more than one million strokes and is therefore much more durable than the known stripping devices.

The protruding section 18 of the stripping element, which corresponds to the stripping element according to FIGS. 2 to 4 except for the dimensions, may, in addition to the means for securing against rotation, also produce a stroke limit. This takes place by the fact that said element can be displaced until at maximum shortly before the end plate 13 or 29. By the provision of the means of securing against rotation in the form of the elongated hole 14, 31 and the corresponding design of the stripping element, in addition to the guidance function shearing forces may also be intercepted. Depending on the application, it is also possible to undertake a matching to different stem diameters of the punch by differently sized passage openings 25 or 30 of the stripping element or of the passage opening 32 of the spring-elastic element. Larger lateral forces which occur can also be intercepted by the larger guide length of the guide sleeve. As in FIGS. 2 to 4, the guidance in respect of the stripping element again takes place from the inside and outside, i.e. in the end plate 29 of the guide sleeve 26 and on the punch along the passage opening 32 of the stripping element 15. In spite of the partially very different shaping of the front surface of the stripping element, torques acting on the stripping device can be optimally intercepted by the provision of the guide surface pairings and the device for securing against rotation.

Figure 9:
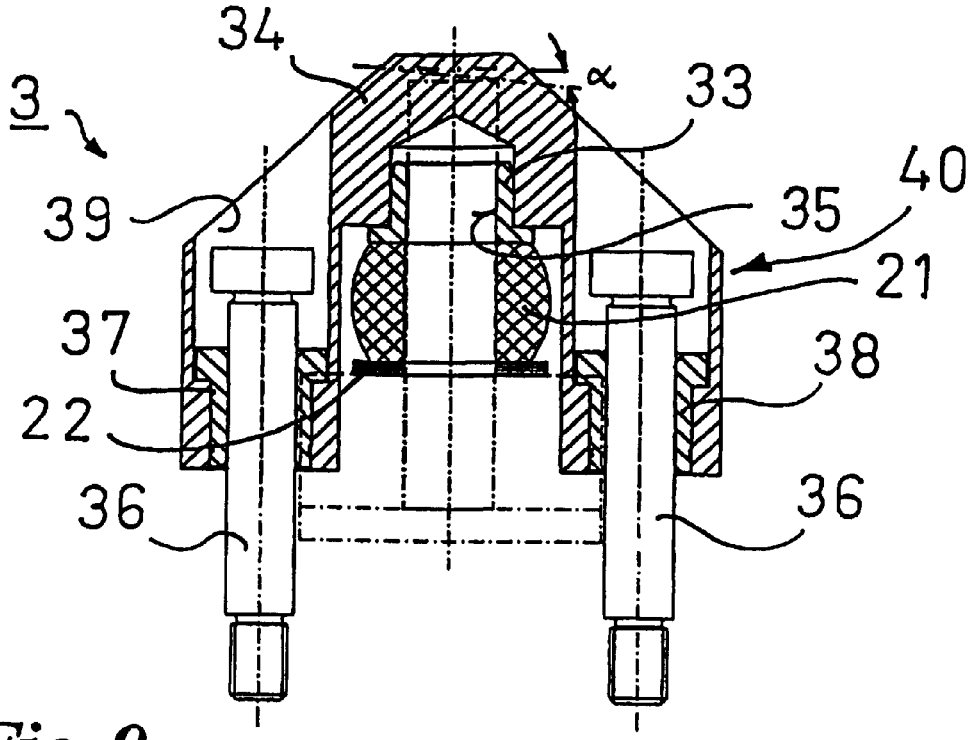
FIG. 9 shows a longitudinal sectional view of a further embodiment of a stripping device according to the invention for severe forces which occur.
Figure 10:
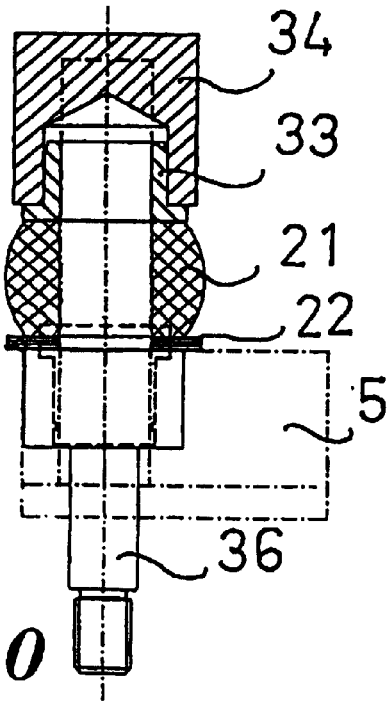
FIG. 10 shows a longitudinal sectional view of the stripping device according to FIG. 9.
Figure 11:
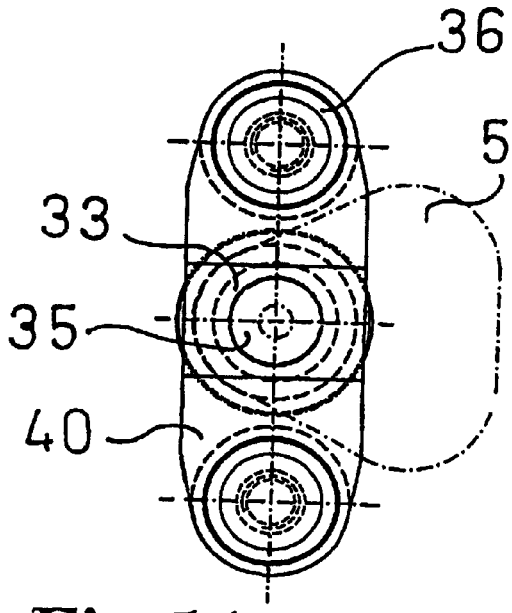
FIG. 11 shows a plan view of the stripping device according to FIG. 9.

FIGS. 9 to 11 illustrate an embodiment which is suitable for particularly high shearing forces or lateral forces. In this embodiment, guide bushings 33 are provided instead of guide sleeves, the guide bushings 33 being arranged within a stripping element 34. The guide bushing 33 runs along the punch (not illustrated). For this purpose, it has an inner passage opening 35. The stripping element 34 is designed to be larger than in FIGS. 2 to 8. It is in the form of a truncated trapezoid, with large passage openings 39 in which fastening means for fastening the stripping device to the cutting tool fit. This region of the stripping element is the fastening section which, instead of a separate fastening plate and a fastening section as in FIGS. 5 to 8, is formed on the stripping element itself. In order to be able to better absorb lateral or shearing forces, fastening to the cutting tool is provided via two fitting shoulder screws 36. The latter fit in guide bushings 37, 38 which are fitted into steps in the passage openings 39.

As can be gathered from FIG. 11, the fitting shoulder screws 36 are fastened directly in the cutting tool, surrounding the fastening plate 5 for the punch on both sides. This corresponds to the construction according to FIGS. 5 to 8. In comparison to the embodiments according to FIGS. 2 to 4 and 5 to 8, the guide length of the stripping element is increased once again, this length being determined by the shaping of the stripping element and the manner of fastening via three guide bushings. In this case, guidance of the stripping element from the outside and from the inside is provided, as can be gathered in particular from FIG. 9, along the punch and on the fitting shoulder screws. This embodiment is secured against inadvertent rotation by provision of a special formation of the region of the stripping element which surrounds the two fitting shoulder screws 36 and is intended for engaging around the fastening plate 5, and by the fastening to the cutting tool via the two fitting shoulder screws (see in particular FIG. 11).

In addition to the embodiments described above and illustrated in the figures, numerous further embodiments may also be formed, in which in each case a stripping element which comes into contact with the workpiece and surrounds a cutting element, at least one guide device guiding the stripping element and a means for securing against rotation are provided on the stripping element. A spring-elastic element which is likewise provided is arranged outside the workpiece contact region and serves merely for damping and restoring the stripping device.

LIST OF REFERENCE NUMBERS

1 Cutting tool
2 Punch
3 Stripping device
4 Fastening plate
5 Fastening plate
6 Metal sheet

7 Front surface
8 Mating punch
9 Passage opening
10 Screw
11 Guide sleeve
12 Protruding section
13 End plate
14 Elongated hole
15 Stripping element
16 Lubricant
17 Straight section
18 Protruding section
19 Inner surface
20 Lower side
21 Spring-elastic element
22 Retaining disk
23 Outer surface
24 Outer surface
25 Passage opening
26 Guide sleeve
27 Straight section
28 Fastening plate part
29 End plate
30 Passage opening
31 Elongated hole
32 Passage opening
33 Guide bushing
34 Stripping element
35 Passage opening
36 Fitting shoulder screw
37 Guide bushing
38 Guide bushing
39 Passage opening
40 Fastening section
50 Protruding region
51 Protruding section
52 Outer edge
53 Fixing pin
141 Long straight side
142 Long straight side
143 Short straight side
144 Curved side
145 Corner transition
146 Corner transition
311 Long straight side
312 Long straight side
313 Short straight side
314 Curved side
315 Corner transition
316 Corner transition
$\alpha$ Bevel angle

The invention claimed is:

1. A stripping device for use with a cutting tool with a cutting element for machining a workpiece, the cutting element being movable along a longitudinal axis, the stripping device comprising:

at least one fastening piece for fastening the stripping device to the cutting tool;

a spring-elastic element which is arranged outside the workpiece contact region and around the cutting element;

a stripping element which surrounds the cutting element, wherein the stripping element has a non-circular cross-section and a front surface, the front surface being defined by a beveled portion having a bevel angle, the beveled portion coming into contact with the workpiece along a contact plane, and wherein the contact plane defines a non-zero angle with respect to a plane perpendicular to the longitudinal axis at least when the cutting element passes through the workpiece, and wherein the beveled portion comprises an inner periphery which defines a passage opening through which the cutting element passes, and wherein the bevel angle surrounds the passage opening and extends from one side of the front surface, over the passage opening, and to the other side of the front surface; and a guide element having an outer surface with a circular cross-section and having an inner surface defining a hole with a non-circular cross-section corresponding in shape with the non-circular cross-section of the stripping element, the entire surface of the hole being formed by a single homogenous piece of material, wherein the guide element is configured to guide the stripping element and independently prevent the stripping element from rotating.

2. The stripping device as in claim 1, wherein the stripping element has a cross-sectional shape with no rotational symmetry.

3. The stripping device as in claim 1, wherein the hole has an elongated or polygonal shape.

4. The stripping device as in claim 1, wherein the stripping element has a cross-sectional shape with three straight sides and one curved side.

5. The stripping device as in claim 1, wherein the guide element comprises at least one guide sleeve arranged outside the stripping element, at least partially surrounding the stripping element in a guiding manner.

6. The stripping device as in claim 1, further comprising at least one guide surface between the stripping element and the guide element, a length of which surface can be provided as a function of the forces acting on the stripping device in order to ensure tilt-free guidance.

7. The stripping device as in claim 6, wherein the stripping element has an essentially straight section and a protruding section, and wherein the stripping device comprises guide surfaces on the straight and the protruding sections of the stripping element.

8. The stripping device as in claim 1, wherein the stripping element has at least one guide surface on its inside facing the cutting element and/or the stripping element and the spring-elastic element are oriented, surrounding the cutting element, in such a manner that they can be loaded in a manner essentially free from torque.

9. The stripping device as in claim 1, wherein a lubricant is provided at least in a subregion of the straight section.

10. The stripping device as in claim 1, wherein the guide element is formed integrally with the fastening piece or the guide element and the fastening piece are formed as elements which can be joined together.

11. The stripping device as in claim 1, wherein the spring-elastic element is arranged between the stripping element or the guide element and the cutting tool and/or within the guide element.

12. The stripping device as in claim 1, wherein at least one protruding region and/or protruding section is or are provided on the circumference of the fastening plate for engaging around a fastening device of the cutting tool.

13. The stripping device as in claim 1, wherein the stripping element has a front surface corresponding to the workpiece.

14. The stripping device as in claim 1, wherein the spring-elastic element is a rubber spring or consists of another spring-elastic, restoring or flexible material.

15. The stripping device as in claim 6, wherein the forces are shearing and lateral forces.

16. The stripping device as in claim 8, wherein the at least one guide surface faces a stem of the fitted cutting element.

17. The stripping device as in claim 13, wherein the front surface comprises bronze or another material which can be machined and matched to the shape of the workpiece surface.

18. The stripping device as in claim 1, wherein the at least one fastening piece is for detachably fastening the stripping device to the cutting tool.

19. The stripping device as in claim 1, wherein the beveled portion is planar and defines a non-perpendicular bevel angle with respect to the longitudinal axis.

20. The stripping device as in claim 1, wherein the front surface comprises a first surface portion at a non-zero angle to a second surface portion when the cutting element passes through the workpiece.

21. The stripping device as in claim 1, wherein the defined angle is between 5 and 10 degrees.

22. The stripping device as in claim 1, wherein the front surface is shaped in accordance to a shape of the workpiece.

23. The stripping device as in claim 1, wherein the entire front surface is beveled and contacts the workpiece.

24. The stripping device as in claim 1, wherein the defined angle is between 0 and 5 degrees.

25. The stripping device as in claim 1, wherein the front surface is formed by beveling a cylindrical front portion of the stripping element so as to provide said opening through which the cutting element passes.

* * * * *